US006548433B1

(12) United States Patent
Gbur et al.

(10) Patent No.: US 6,548,433 B1
(45) Date of Patent: Apr. 15, 2003

(54) POROUS WEB MATERIAL

(75) Inventors: Ivan Gbur, Darwen (GB); Brian Tomkinson, Bradshaw (GB); Joyce Alston, Heywood (GB)

(73) Assignee: J. R. Compton Limited, Lancashire (GB)

( * ) Notice: Subject to any disclaimer, the term of this patent is extended or adjusted under 35 U.S.C. 154(b) by 0 days.

(21) Appl. No.: 09/367,427

(22) PCT Filed: Feb. 12, 1998

(86) PCT No.: PCT/GB98/00311

§ 371 (c)(1),
(2), (4) Date: Dec. 6, 1999

(87) PCT Pub. No.: WO98/36128

PCT Pub. Date: Aug. 20, 1998

(30) Foreign Application Priority Data

Feb. 12, 1997 (GB) ..... 9702857

(51) Int. Cl.[7] ..... B32B 5/06

(52) U.S. Cl. ..... 442/389; 428/316.6; 426/77; 426/84

(58) Field of Search ..... 426/77, 84; 428/316.6; 442/389

(56) References Cited

U.S. PATENT DOCUMENTS

| | | | | |
|---|---|---|---|---|
| 2,531,594 A | | 11/1950 | Abrahams | |
| 2,928,765 A | | 3/1960 | Kurjan | |
| 3,386,834 A | | 6/1968 | Noiset et al. | 426/84 |
| 3,529,925 A | | 9/1970 | Thomas et al. | 8/118 |
| 3,640,727 A | | 2/1972 | Heusinkveld | |
| 4,582,666 A | | 4/1986 | Kenworty et al. | |
| 4,661,255 A | | 4/1987 | Guenther et al. | |
| 4,801,464 A | | 1/1989 | Hubbard, Jr. | |
| 5,169,496 A | | 12/1992 | Dinkar et al. | |
| 5,173,154 A | * | 12/1992 | Heinrich | 162/129 |
| 5,288,402 A | | 2/1994 | Yoshida | |
| 5,443,606 A | | 8/1995 | Hassenboehlev, Jr. et al. | |
| 5,496,573 A | | 3/1996 | Tsuji et al. | |
| 5,500,167 A | | 3/1996 | Degen | |
| 5,601,716 A | * | 2/1997 | Heinrich et al. | 210/490 |
| 5,780,369 A | | 7/1998 | Allison et al. | |
| 6,139,883 A | | 10/2000 | Gbur et al. | |

FOREIGN PATENT DOCUMENTS

| | | |
|---|---|---|
| CA | 651488 | 10/1962 |
| DE | 26 36 486 | 2/1978 |
| EP | 109282 | 5/1984 |
| EP | 615921 | 9/1994 |
| GB | 500542 | 2/1978 |
| GB | 041030 | 9/1980 |
| WO | WO 04956 | 2/1987 |
| WO | WO 9709167 | 3/1997 |

* cited by examiner

*Primary Examiner*—Terrel Morris
*Assistant Examiner*—John J. Guarriello
(74) *Attorney, Agent, or Firm*—Woodard, Emhardt, Naughton, Moriarty & McNett

(57) ABSTRACT

A fibrous, porous web material of the heat seal type having improved particulate retention properties for use in the manufacture of beverage infusion bags. The material comprises juxtaposed, successively wet laid first (1), second (5) and third (7) fibrous layers, at least one of said layers incorporating heat sealable fibres. The fibres in the first layer are of greater aspect ratio than those in the second layer which are of higher aspect ratio than those in the third layer.

20 Claims, 1 Drawing Sheet

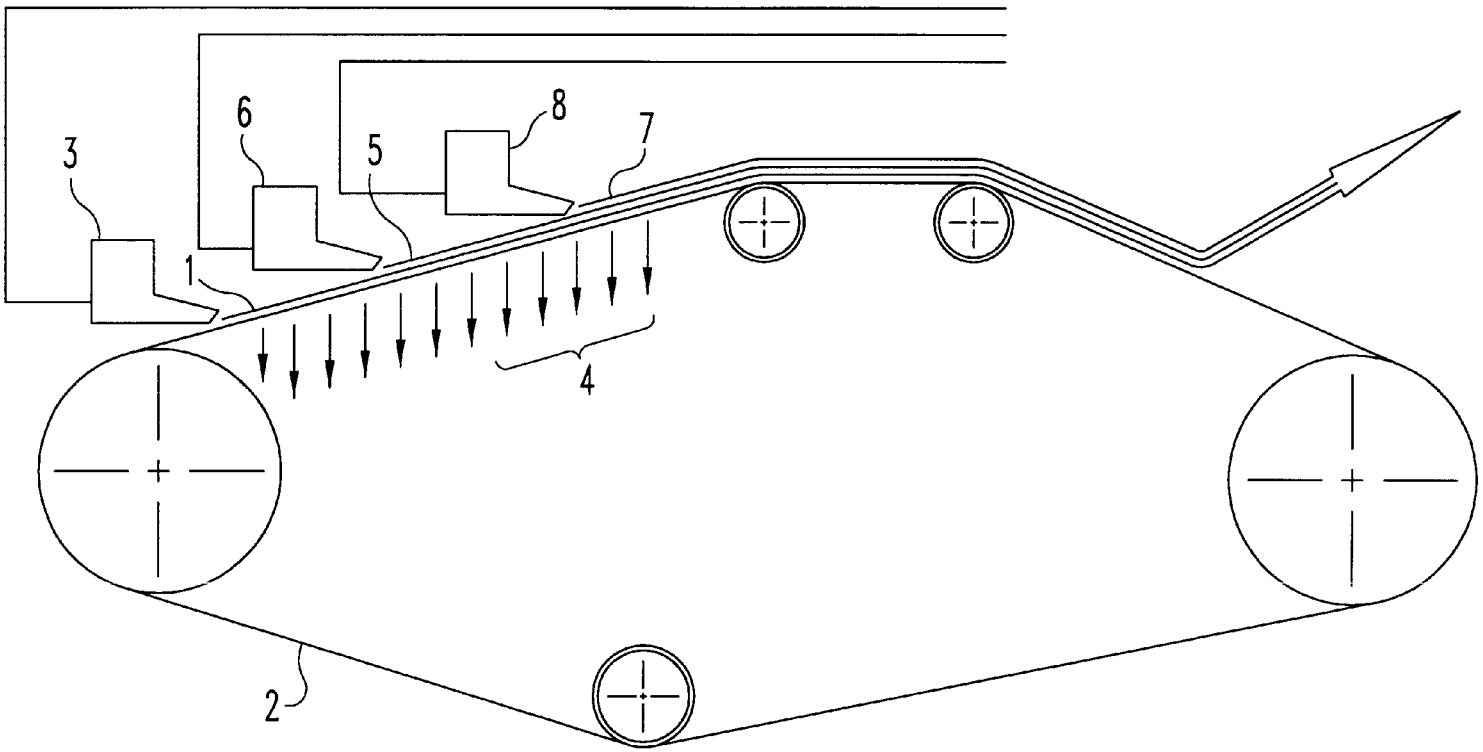
1
2
3
4
5
6
7
8

POROUS WEB MATERIAL

The present invention relates to a fibrous, porous web material of the heat seal type intended for use particularly, but not exclusively, for the production of infusion sachets for brewing beverages such as tea, coffee and the like.

Infusion sachets for brewing beverages (e.g. so called teabags and coffee bags) are generally produced in either "heat seal" or "non-heat seal" generic types of fibrous porous web material (hereinafter also referred to as paper for convenience). Heat seal paper (with which the present invention is concerned) generally comprises two layers. One of these two layers is a bonding layer which includes fusible polymeric fibres which allow two layers of the paper to be heat sealed together in the production of infusion bags. The other layer is present as an insulation layer to prevent polymer (in the other layer) sticking to heated dies during conversion of the paper to produce an infusion sachet.

One example of commercially available heat seal paper is that manufactured by J.R. Crompton Limited under the name SUPERSEAL (Registered Trade Mark) which comprises a bonding layer incorporating relatively long (e.g. ca 5 mm) polypropylene, rayon and vegetable fibres, and a thermally inert layer of cellulosic fibres. Overall, the SUPERSEAL paper has a depth corresponding to a thickness of about 6–8 fibres with the bonding layer being of greater thickness than the thermally inert layer (in which the "long" fibres of the bonding layer are keyed).

There is however a problem in some areas with the known heat seal papers for use in the production of teabags in that fine tea dust (resulting from interaction of tea leaves during processing thereof) or fine particles of tea having a tendency to pass through the paper to the outside of the teabag. Since teabags are generally packaged in boxes or other types of "outer" packaging, the fine tea particles or dust are "loose" in the packaging and this is undesirable from the aesthetic viewpoint.

Depending on the packaging size, there may be up to a few milligrams of fine tea particles or dust "loose" in the packaging.

One strategy for overcoming this problem would be to increase the percentage of finer fibres (preferably hardwood fibres) in the stock from which the double ply paper is produced. This would result in a paper with smaller pores thus reducing the amount of fine tea or tea dust which can pass through the paper. Obviously the reduction in porosity would not be so high as to prevent passage of water through the material during infusion of the beverage.

However, an increased amount of hardwood or other short fibres in either of the two layers will reduce the strength of the paper possibly to the extent that (for the required pore size) the strength is insufficient for manufacture of the paper into infusion bags. A further disadvantage which would be associated with the use of hardwood or other short fibres would be the generation of "pin holes" in the paper resulting from general papermaking problems, e.g. air entrainment and wetness.

A further proposal for improving the particulate retention properties of a heat-sealable filter material to be used in the manufacture of beverage infusion bags is disclosed in U.S. Pat. No. 5,601,716. In accordance with this proposal, a filter material is produced by wet laying a first, fibrous layer on a paper-making machine and then depositing onto this layer, a plurality of individual synthetic or plastic fibres (which provide the heat-seal properties for the filter material) in a heated condition so that the synthetic or plastic fibres are able to fuse between themselves as well as with the fibres of the first layer. The synthetic or plastic fibres may be produced and deposited using a conventional melt spinning technique. The need to produce the heated synthetic or plastic fibres as separate process steps subsequent to the process of wet-laying and drying the first fibrous layer represents a disadvantage of this process. Furthermore, the random deposit of the synthetic or plastic fibres does not necessarily "target" large pores in the wet-laid layer so there may be an inconsistent improvement in filtration efficiency.

It is therefore an object of the present invention to obviate or mitigate the abovementioned disadvantages.

According to a first aspect of the present invention there is provided a fibrous, porous web material of the heat seal type having improved particulate retention properties for use in the manufacture of beverage infusion bags, the material comprising juxtaposed, successively wet laid first, second and third fibrous layers, at least one of said layers incorporating heat sealable fibres wherein the fibres in the first layer are of greater aspect ratio than those in the second layer which are of higher aspect ratio than those in the third layer.

According to a second aspect of the present invention there is provided a method of producing a fibrous, porous web material of the heat seal type of improved particulate retention properties for use in the manufacture of beverage infusion bags, the method comprising successively laying first, second and third fibrous layers whilst effecting drainage from formation of the first layer to formation of the third layer structure, at least one of said layers incorporating heat sealable fibres, wherein the fibres in the first layer are of greater aspect ratio than those in the second layer which are of higher aspect ratio than those in the third layer.

Materials in accordance with the first aspect of the invention have a reduced pore size so that when used for beverage infusion bags the passage of fine particles or dust of the beverage precursor material (e.g. tea leaves) is inhibited. Nevertheless, the material is of adequate strength for manufacture into beverage infusion bags and is of sufficient porosity so as to allow water to pass through the material used during infusion of the beverage.

The material is produced by successively wet laying the first, second and third layers (at least one of which incorporates the heat sealable fibres) onto a water pervious belt at spaced locations. This may be effected by three separate headboxes positioned such that there are free runs of the belt between the positions at which the successive headboxes lay their respective fibrous suspensions. Drainage through the belt is effected at least from formation of the first layer structure to formation of the third layer structure (i.e. over the regions of the free runs of the belt). Drainage of the free run between the first and second headboxes ensures that the first layer has a more coherent structure before the second layer is applied thereto. This ensures that disruption of the first layer by the laying of the second layer is prevented. Similarly the free run of the belt between the second and third headboxes ensures that disruption of the two layer structure by laying of the third layer is prevented.

These features of the method are an important aspect of the invention in their own right and therefore according to a third aspect of the invention there is provided a method of producing a fibrous porous web material of the heat seal type having improved particulate retention properties for use in the manufacture of beverage infusion bags comprising successively wet-laying first, second and third fibrous layers, at least one of which incorporates heat sealable fibres, at spaced locations along a water pervious belt such that there are free runs of the belt between the positions at which the first and second layers and between the positions at which the second and third layers are laid, and effecting drainage through the belt in said free runs from formation of the first layer to formation of the third layer structure.

It is preferred that the drainage of the fibrous web continues beyond the laying of the third layer.

The method of the invention have the advantage that any voids in the first layer caused by (for example) air-entrainment will be filled (as a result of drainage through the voids) by fibres of the second layer, and any remaining voids in the combined structure of the first and second layers will be filled (again as a result of drainage through the voids) by fibres of the third layer. This filling of the voids provides the good filtration properties of the product of the invention. Such filling of the voids in the wet-laid fibrous layer of the product of U.S. Pat. No. 5,601,716 is not ensured by the random laying of synthetic or plastics fibres. Furthermore the invention has the advantage over U.S. Pat. No. 5,601,716 of producing the material wholly by a wet-laying technique thus avoiding the need to melt spin and deposit synthetic and plastics fibres.

The methods of the invention also have the advantage in that for a material of a particular basis weight, the process allows an increased speed of production as compared to the production of a two layer material of the same basis weight dependent on existing constraints.

The methods may be carried out on an "inclined wire" papermaking machine. If desired the "wire" (i.e. the papermaking belt) may have projections (so called knuckles) for forming a pattern of perforations in the paper. Alternatively the material may be patterned using fluid jet perforation.

It is preferred that the heat sealable fibres are provided in at least one of the outer layers of the material although it is within the scope of the invention for these fibres to be provided in an intermediate layer.

The material of the invention preferably has a basis weight of 13 to 19 g $m^{-2}$, more preferably 14 to 18 g $m^{-2}$ and even more preferably 15 to 17 g $m^{-2}$.

The fibres in the first layer are of greater aspect ratio (i.e. length:diameter) than those in the second layer which in turn are of higher aspect ratio than those in the third layer. For preference, the aspect ratio of the fibres in the first layer will have an aspect ratio of greater than 140 to 450 (preferably 200 to 450), those in the second layer an aspect ratio of 140 to 200, and those in the third layer an aspect ratio of 10 to 150 (preferably 40 to 150). It is however possible if required for the fibres of the second and/or third layers to be longer or the same length (and/or more fibrillated) than those of the first layer.

Preferably the fibres of the first layer have a length of 1 to 7 mm (more preferably 3 to 6 mm and most preferably above 5 mm), the fibres of the second layer have a length of 2 to 6 mm (more preferably 2 to 4 mm and most preferably about 3 mm), and those of the third layer have a length of 0.2 to 2.0 mm (preferably 0.5 to 1.5 mm), more preferably about 1 mm.

In preferred constructions of the invention, the fibres of the first layer provide 50% to 90% by weight of the total weight of the web material. It will generally be preferred that the basis weight of the first layer is 8 to 10 g $m^{-2}$ (e.g. 8 to 9 g $m^{-2}$), that of the second layer is 2 to 4 g $m^{-2}$, and that of the third layer is 1 to 4 g $m^{-2}$.

The thermally active layer may, for example, comprise 20 to 40% by weight (based on the total weight of the paper) of the heat seal fibres. The heat seal fibres are preferably of a thermoplastic, most preferably of polypropylene.

In order to provide strength, the thermally active layer may include other types of fibres in addition to the heat seal fibres. These additional fibres may, for example, be of rayon and/or vegetable fibres each in an amount of 5% to 60% of the weight of the thermally active layer. The other layers may be of cellulosic fibres.

In a preferred construction of paper in accordance with the invention, the heat sealable fibres are provided in the first layer. For preference, this first layer is of greater depth than the total depth of the thermally inert layers. The overall thickness of the material may, for example, be 6 to 12 fibres (40–90 microns) with each of the thermally inert layers normally being about 2 fibres deep with the balance of the depth being provided by the thermally active layer.

The invention will be further described by way of Example only with reference to the accompanying drawing which illustrates production of web material in accordance with the invention.

The web material is formed from three fibrous stocks. One stock (for forming the first layer) comprises heat sealable fibres (preferably polypropylene), rayon and vegetable fibres, all preferably having a length of about 3–6 mm (e.g. ca 5 mm). The other two stocks (performing the second and third layers) each comprise cellulosic fibres. The second and third layers may comprise softwood, hardwood and/or vegetable fibres having respective lengths of 2–6 mm, 0.8 to 1.5 mm and 0.8 to 3 mm.

As shown in the drawing, the stock (which may be comprised of polypropylene, rayon and vegetable fibres) for forming the first layer 1 is laid onto a continuously moving paper forming fabric 2 from a first headbox 3. Water is drained through the first layer as shown by the arrows 4. The second layer 5 (of cellulosic fibres) is then laid from a further headbox 6 prior to laying of the third layer 7 (of cellulosic fibres) from a third headbox 8. Drainage is effected (arrows 4) throughout formation of the three layers. As a result of this drainage, portions of fibres of the second and third layers become "keyed in" to the first layer so as to be mechanically entrapped therein.

On removal from the paper forming fabric, the web is passed around a steam heated drying cylinder (not shown) followed by a hot air fusing step and rehumidifying step prior to being reeled up.

Beverage infusion sachets containing a beverage precursor material (e.g. tea or coffee) may be produced from the web by heat sealing juxtaposed thermally active layers using conventional techniques.

This invention will be further described with reference to the following non-limiting Example.

EXAMPLE

A heat seal paper in accordance with the invention was produced as a three layer structure in which the first layer comprised rayon and polypropylene fibres, the second layer comprised softwood fibres and the third layer hardwood fibres. The aspect ratios of the fibres used for the layers are shown in the following Table.

A comparative, two layer material was produced in which the first layer comprised rayon and polypropylene fibres and the second layer comprised softwood fibres. The aspect ratios of these fibres are shown in the Table.

The basis weights of the second and third layers of the material according to the invention were respectively 75% and 25% of the basis weight (5 gsm) of the second layer of the comparative material.

The properties of the material are as shown in the Table.

TABLE

| NUMBER OF LAYERS | | INVENTION 3 | COMPARATIVE 2 |
|---|---|---|---|
| ASPECT RATIO OF FIBRES IN FIRST LAYER | LENGTH/WIDTH RATIO | 330 | 330 |
| ASPECT RATIO OF FIBRES IN SECOND LAYER | LENGTH/WIDTH/RATIO | 155 | 155 |
| ASPECT RATIO OF FIBRES IN THIRD LAYER | LENGTH/WIDTH RATIO | 50 | |
| BASIS WEIGHT | $g/m^2$ | 16.6 | 16.1 |
| THICKNESS | microns | 76 | 77 |
| AIR PERMEABILITY | $m^5/min/m^2$ | 98 | 113 |
| TOTAL MASS OF TEA PARTICULATES SIFTING OUT PER 80 TEA BAGS | mg/80 bags | 24 | 128 |
| WET BURST STRENGTH | KPa | 14 | 19 |
| DRY BURST STRENGTH | KPa | 26 | 28 |
| DRY TENSILE STRENGTH | | | |
| MACHINE DIRECTION | g/mm | 45 | 48 |
| CROSS DIRECTION | g/mm | 14 | 16 |
| DRY TEAR STRENGTH | | | |
| MACHINE DIRECTION | g | 18 | 21 |
| CROSS DIRECTION | g | 25 | 29 |
| HEAT SEAL STRENGTH (SEALED AT 165° C.) | | | |
| HEATSEAL/HEATSEAL SIDE | g/50 mm | 443 | 493 |
| NON HEATSEAL/NON HEATSEAL SIDE | g/50 mm | 92 | 120 |

The two materials were fabricated into tea bags which were then shaken fro a fixed period of time. Subsequently the mass (per 80 tea bags) of particulate material which had "sifted out" of the bags was measured. The results are shown in the Table from which it will be seen that 24 mg of particulate (per 80 tea bags) sifted out of the bags produced from the paper in accordance with the invention compared to 128 mg for the comparative material. The benefits of the invention are therefore clear.

The Table shows that other properties of the material of the invention (e.g. burst strength, tensile strength, tea strength and heat seal strength) are as required for a material to be used for the production of beverage infusion bags.

What is claimed is:

1. A fibrous, porous, heat sealable web material having improved particulate retention properties for use in the manufacture of beverage infusion bags, the material comprising juxtaposed, successively wet laid first, second and third fibrous layers, at least one of said layers incorporating heat sealable fibres wherein the fibres in the first layer are of greater aspect ratio than those in the second layer which are of higher aspect ratio than those in the third layer.

2. A material as claimed in claim 1 having a basis weight of 13 to 19 g $m^{-2}$.

3. A material as claimed in claim 2 having a basis weight of 14 to 18 g $m^{-2}$.

4. A material as claimed in claim 3 having a basis weight of 15 to 17 g $m^{-2}$.

5. A material as claimed in claim 1 wherein the aspect ratio of the fibres in the first layer is greater than 140 to 450, that of the fibres in the second layer is 140 to 200, and that of the fibres in the third layer is 10 to 150.

6. A material as claimed in claim 1 wherein the fibres of the first laid layer have a length of 1 to 7 mm.

7. A material as claimed in claim 1 wherein the fibres of the second laid layer have a length of 2 to 6 mm.

8. A material as claimed in claim 1 wherein the fibres of the third laid layer have a length of 0.2 to 2.0 mm.

9. A material as claimed in claim 1 wherein the fibres of the first laid layer provide 50% to 90% by weight of the total weight of the web material.

10. A material as claimed in claim 1 comprising 20 to 40% by weight of the heat sealable fibres based on the total weight of the web material.

11. A material as claimed in claim 1 wherein the heat sealable fibres are of a thermoplastic material.

12. A material as claimed in claim 11 wherein the thermoplastic is polypropylene.

13. A material as claimed in claim 1 wherein the layer incorporating heat sealable fibres additionally incorporates rayon and/or vegetable fibres.

14. A material as claimed in claim 13 wherein the layer incorporating heat sealable fibres incorporates, by weight of that layer, 5% to 60% by weight of rayon fibres and/or 5% to 60% by weight of vegetable fibres.

15. A material as claimed in claim 1 wherein the heat sealable fibres are provided in at least one of the outer layers of the material.

16. A material as claimed in claim 15 wherein the heat sealable fibres are provided in the first laid layer.

17. A material as claimed in claim 1 having an overall thickness of 6 to 12 fibres.

18. A material as claimed in claim 17 wherein two of said layers are thermally inert layers and each have a depth of about 2 fibres, the balance of the depth of the material being provided by at least one layer incorporating heat sealable fibres.

19. A beverage infusion bag comprising a beverage precursor material enclosed within a heat sealed sachet formed of a material as claimed in claim 1.

20. A method of producing a fibrous, porous, heat sealable web material of improved particulate retention properties for use in the manufacture of beverage infusion bags, the method comprising successively laying first, second and third fibrous layers whilst effecting drainage from formation of the first layer to formation of the third layer structure, at least one of said layers incorporating heat sealable fibres, wherein the fibres in the first layer are of greater aspect ratio than those in the second layer which are of higher aspect ratio than those in the third layer.

* * * * *

UNITED STATES PATENT AND TRADEMARK OFFICE

CERTIFICATE OF CORRECTION

PATENT NO. : 6,548,433 B1
DATED : April 15, 2003
INVENTOR(S) : Gbur et al.

It is certified that error appears in the above-identified patent and that said Letters Patent is hereby corrected as shown below:

Title page,
Item [73], Assignee, please change "J. R. Compton Limited" to
-- J. R. Crompton Limited --

Signed and Sealed this

Nineteenth Day of August, 2003

JAMES E. ROGAN
*Director of the United States Patent and Trademark Office*